US007168434B2

(12) United States Patent
Baldwin

(10) Patent No.: US 7,168,434 B2
(45) Date of Patent: Jan. 30, 2007

(54) HAIR RETAINING DEVICE

(76) Inventor: J. Hannah Baldwin, 30 Linden Point Rd., Stony Creek, CT (US) 06405

( * ) Notice: Subject to any disclaimer, the term of this patent is extended or adjusted under 35 U.S.C. 154(b) by 187 days.

(21) Appl. No.: 10/706,556

(22) Filed: Nov. 12, 2003

(65) Prior Publication Data

US 2004/0094179 A1 May 20, 2004

Related U.S. Application Data

(60) Provisional application No. 60/425,069, filed on Nov. 12, 2002.

(51) Int. Cl.
*A45D 8/04* (2006.01)
*A45D 8/40* (2006.01)
*A42B 5/00* (2006.01)

(52) U.S. Cl. ..... 132/273; 132/274; 2/207

(58) Field of Classification Search ..... 132/273–274; 2/171, 174, 68, 207, 200.1, 200.03, 209.7, 2/171.03; D2/875
See application file for complete search history.

(56) References Cited

U.S. PATENT DOCUMENTS 1,300,644 A * 4/1919 Phillips ..... 2/171.04
2,211,184 A * 8/1940 Varell ..... 2/174
3,019,444 A * 2/1962 Pollack et al. ..... 2/68
3,197,787 A * 8/1965 Toguan et al. ..... 2/171
D206,992 S * 2/1967 Skier ..... D2/877
3,351,073 A * 11/1967 Gregg ..... 2/209.3
3,556,115 A * 1/1971 Benson ..... 132/274
3,561,455 A * 2/1971 Gregg ..... 132/274
5,156,171 A 10/1992 Goodman ..... 132/200
D364,495 S 11/1995 Smith ..... D2/877
5,920,909 A 7/1999 Ellsworth et al. ..... 2/171

* cited by examiner

*Primary Examiner*—John J. Wilson
*Assistant Examiner*—Robyn Doan
(74) *Attorney, Agent, or Firm*—St. Onge Steward Johnston & Reens LLC

(57) ABSTRACT

A hair retaining device for placement on a head comprises an annular, elasticized portion for adjusting to heads of varying sizes and for encircling a wearer's head, said headband having an upper edge and a hair retainer gathered at and extending upwardly from said upper edge of said elasticized portion and terminating at a generally circular retaining lip.

15 Claims, 6 Drawing Sheets

HAIR RETAINING DEVICE

PRIOR APPLICATION

Applicant claims priority benefits under 35 U.S.C. §119 (e) of U.S. Provisional Patent Application Ser. No. 60/425,069 filed Nov. 12, 2002.

FIELD OF THE INVENTION

The present invention relates to a device for retaining hair and keeping it away from the face of the wearer.

BACKGROUND OF THE INVENTION

Headbands which encircle the head partially or fully and include a means, typically elastic, to stay upon the head, are known. Headbands may be worn about the forehead for athletic purposes often, such as a sweatband, or about the hair itself, for ornamental purposes, to retain a desired hairstyle, or to keep hair off the face.

There remains a need for a device to retain hair off the face of the wearer without crushing the hair.

SUMMARY OF THE INVENTION

A hair retaining device for placement on a head comprises an annular, elasticized portion for adjusting to heads of varying sizes and for encircling a wearer's head, said headband having an upper edge and a hair retainer gathered at and extending upwardly from said upper edge of said elasticized portion and terminating at a generally circular retaining lip, said lip having a diameter and said upper edge having a diameter smaller than the said lip diameter to form a frustoconical collar for retaining hair.

DETAILED DESCRIPTION OF THE DRAWINGS

Figure 1:
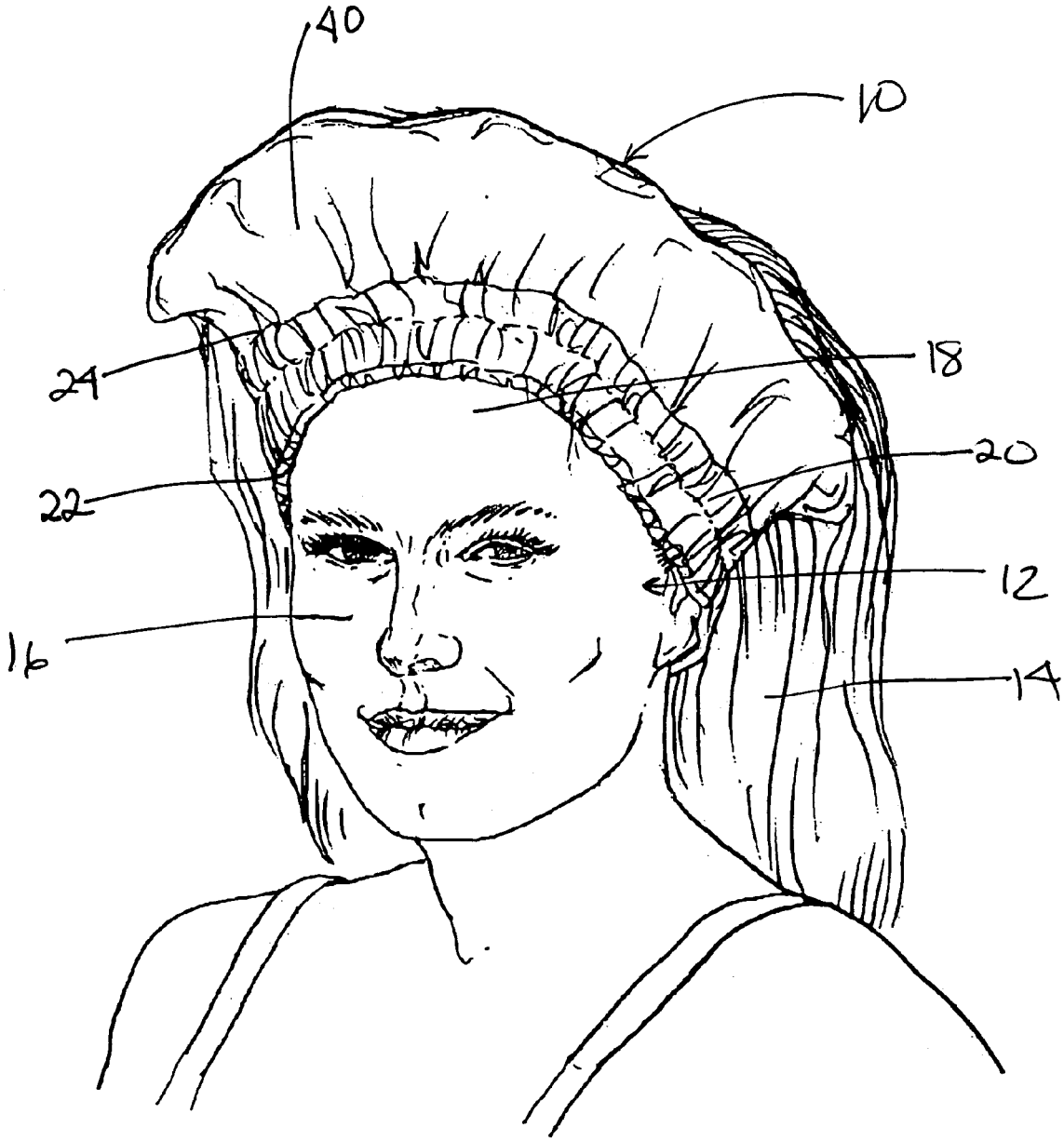
FIG. 1 is front perspective view of the hair band of the present invention placed on the head of the wearer.

FIG. 1 shows hair retaining device 10 generally, placed on the head 12 of the wearer. Device 10 is designed to hold back the hair of the wearer and keep it off the face 16 of the wearer so that make-up may be applied, the face 16 may be washed, or for other purposes when one would need to keep hair 14 away from the face 16. Device 10 includes elasticized portion 20 and hair retainer 40. Elasticized portion 20 contracts about the head 12 of the wearer to hold device 10 in place. Elasticized portion 20 specifically contracts around the forehead 18, along the hairline of the wearer, so as to not disturb or crush the hair 14 itself.

Elasticized portion 20 is annular and has a lower edge 22 and an upper edge 24. Extending upwardly from the upper edge 24 is hair retainer 40. Hair retainer 40, when placed on the head 12 of the wearer, is frustoconical in shape and sufficiently stiff to retain that shape and prevent it from resting upon the hair 14 on the wearer's head 12. This prevents the disturbance of any hairstyle while keeping hair 12 from falling forward onto the face 16.

Figure 2:
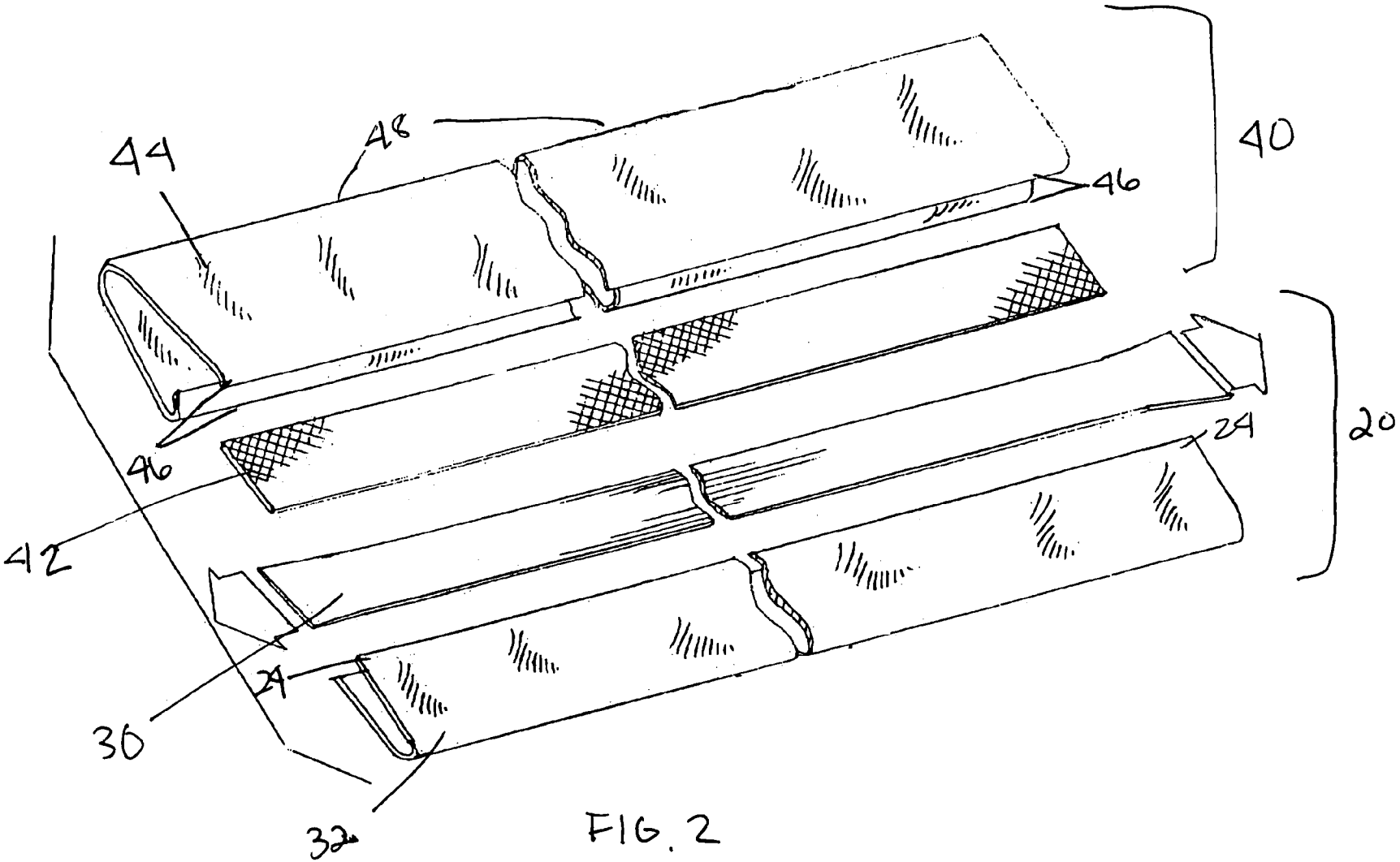
FIGS. 2–3 are assembly views of the hair band of FIG. 1.
Figure 3:
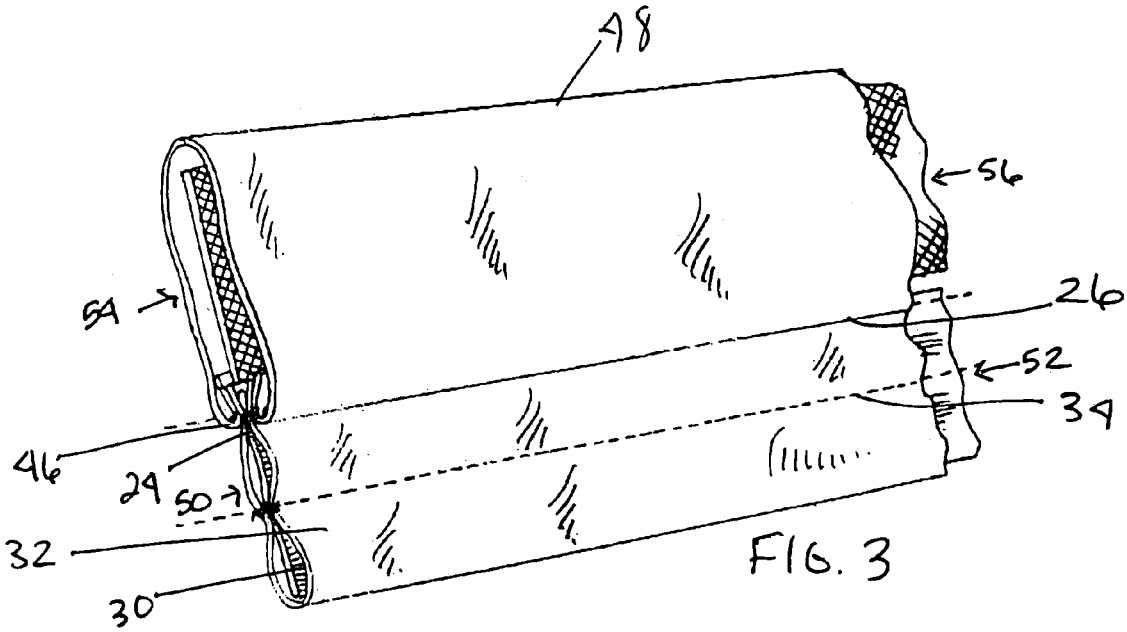

Elasticized portion 20 may include any elasticized material or an elastic 30 within a suitable material or fabric covering 32, as shown in FIGS. 2–3. Fabric covering 32 is comfortable to wear upon a head and soft when contacting the wearer's skin. Suitable fabrics include, but are not limited to, cotton and terrycloth. Fabric covering 32 may be absorbent to soak up water or other liquids to prevent them from wetting or contacting hair 14, for instance, if wearer is washing her face 16.

Figure 4:
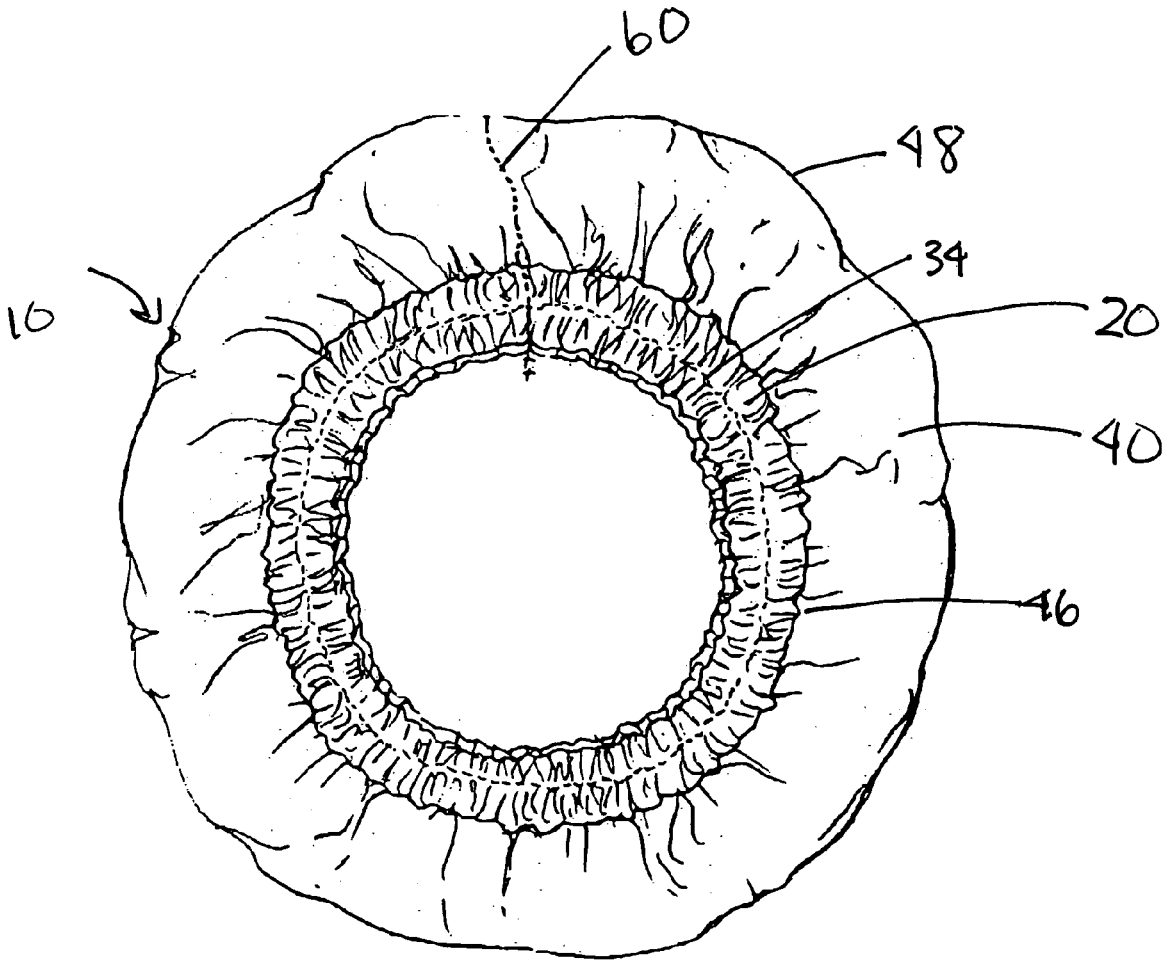
FIG. 4 is a top view of the hair band of FIG. 1.

FIGS. 2–3 show assembly of the device 10. Elastic 30, fully expanded, may be placed between a folded piece of fabric covering 32, with its length equaling that of fabric covering 32. Center stitch 34 is made laterally through elastic 20 and fabric covering 32, along the entire length. When elastic 30 is released and allowed to contract, fabric covering 32 puckers, as shown in FIG. 4. This allows device 10 to be adjustable to heads of various sizes and for elastic 30 and fabric covering 32 to expand and contract simultaneously.

Hair retainer 40 may be made of any suitable material or combination of materials to allow it to retain its frustoconical shape. For instance, as shown in FIG. 2, stiffening material 42, such as mesh, netting, tulle, and the like, may be disposed within fabric 44. Fabric 44 is preferably the same material as that of fabric covering 32 of elasticized portion 20.

Fabric 44 is of substantially the same length as elastic 30, as fully expanded, and fabric covering 32. Lower edge 46 of hair retainer 40 is stitched or otherwise attached to upper edge 24 of elasticized portion 20 at seem 26. Alternatively, fabric 44 and fabric covering 32 may be the same piece of fabric with stitching 26 disposed between the elasticized portion 20 and hair retainer 40 when assembling the device 10.

Figure 5:
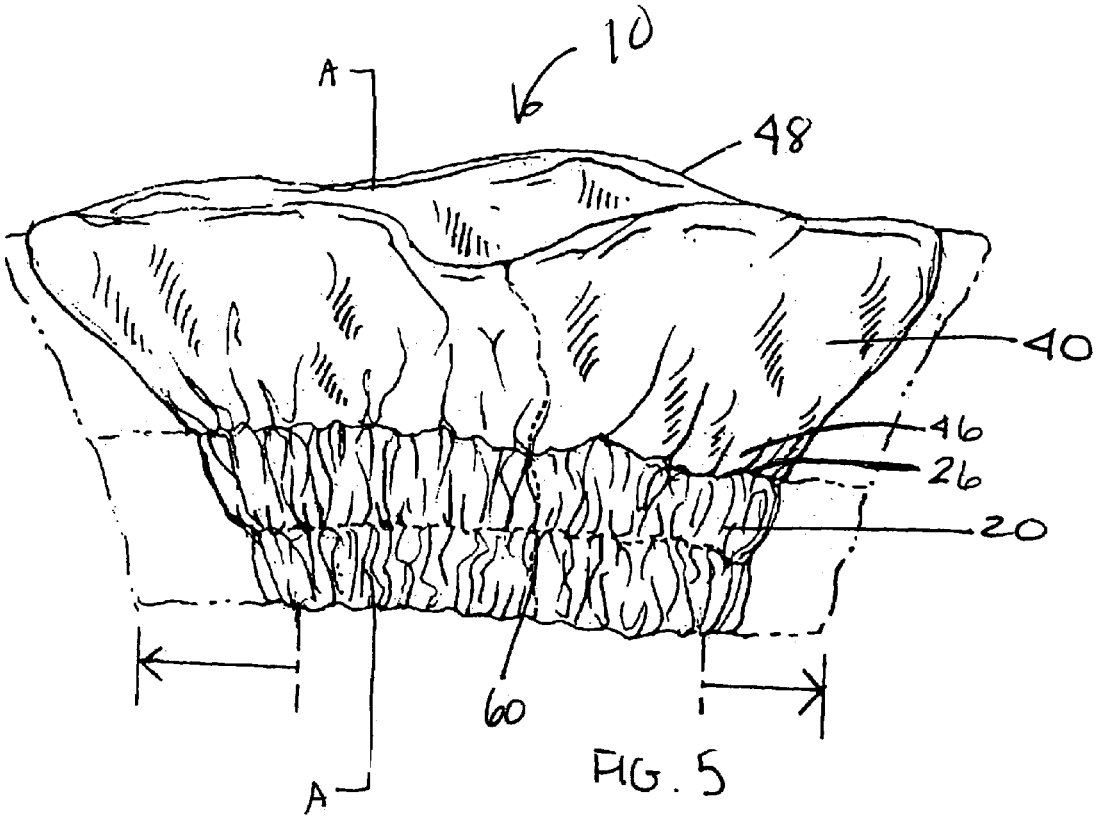
FIG. 5 is a front perspective view of the hair band of FIG. 1.

As shown in FIGS. 2–3, fabric 44 of hair retainer 40 is gathered at its lower edge 46 where it is stitched to upper edge 24 of elasticized portion 20 at seem 26. The gathering results in hair retainer 20 tapering from its upper edge 48 to its lower edge 46 at seem 26, as shown in FIGS. 4–5. The tapering continually reduces the diameter of the hair retainer 40 from its upper edge or retaining lip 48 to its lower edge 46 at seem 26 to create a frustoconical shaped collar about the head 12 when elastic portion 20 expands for placement on head 12, as shown in FIG. 5.

FIGS. 4–5 show the assembled device 10, after ends 50, 52 of elasticized portion 20 and ends 54, 56 of hair retainer 40 have been attached together at stitch 60 to achieve a continuous and annular assembly of the device 10. As shown in FIG. 5, device 10 is adjustable to fit varying head sizes. When worn on the head 12, diameter of retaining lip 48 of hair retainer 40 is larger than diameter of elasticized portion 20. Only when elasticized portion 20 is fully expanded are these diameters equal in length.

Figure 6:
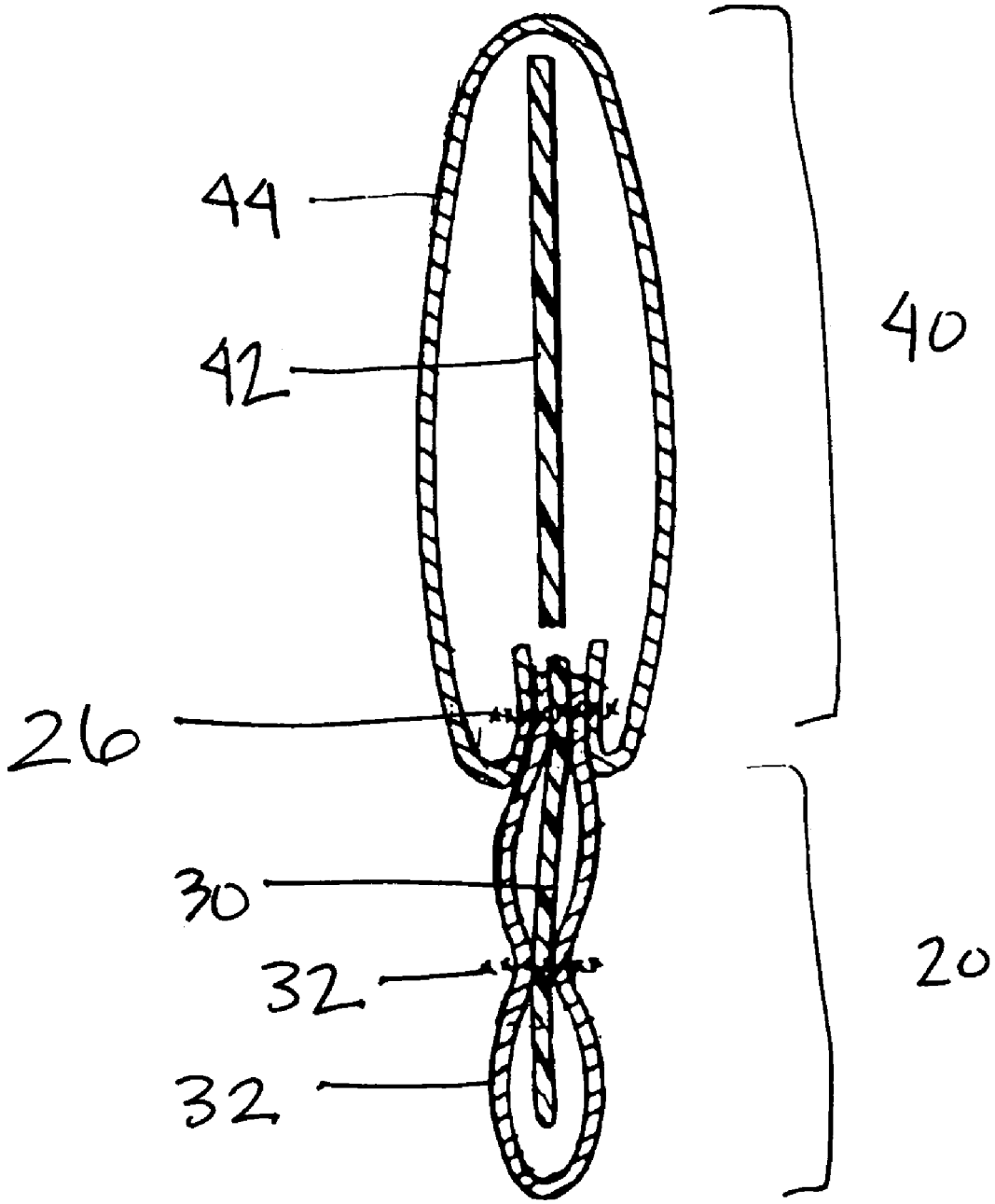
FIG. 6 is a cross-sectional view of the hair band along line A—A of FIG. 5.

FIG. 6 shows a cross sectional view along line A—A of FIG. 5. Elastic portion 20 includes elastic 30 and fabric covering 32 including center stitch 32. Hair retainer 40 includes stiffening material 42 disposed within fabric 44. Elastic portion 20 is attached to hair retainer 40 at seem 26.

What is claimed is:

1. A hair retaining device for placement on a head, said device comprising:

an annular, elasticized portion for adjusting to heads of varying sizes and for encircling a wearer's head, said elasticized portion comprising a continuous elastic disposed within a first fabric covering, the fabric puckered to allow said elastic to expand therein; and a hair retainer comprising a stiffening material disposed within a second fabric covering, said hair retainer gathered at and extending upwardly from an upper edge of said elasticized portion and terminating at a generally circular retaining lip circumscribing an opening, said lip having a diameter and said upper edge having a diameter smaller than the said lip diameter to form a frustoconical collar for retaining hair.

2. The device of claim 1, wherein said hair retainer is at least partially rigid so as to maintain a frustoconical shape and not rest upon said hair when placed on said wearer's head.

3. The device of claim 1, wherein said stiffening material is mesh and said second fabric covering is terrycloth.

4. The device of claim 1, wherein said elastic and said first fabric covering are continuously stitched together.

5. A device for holding hair away from a wearer's face, comprising:

a band of elasticized material for adjustable retention of said device on a wearer's head, said band comprising a continuous elastic disposed in a first fabric covering, the fabric puckered to allow said elastic to expand therein, said band contracting about said wearer's head and having an upper edge;

an annular hair retainer comprising stiffening material disposed in a second fabric covering and extending upwardly from said upper edge and terminating at a generally circular retaining lip circumscribing an opening, said lip having a diameter larger than a diameter of said upper edge, said hair retainer being frustoconical in shape when said band is expanded for placement upon said wearer's head.

6. The device of claim 5, wherein said elastic and said first fabric covering are continuously stitched together.

7. The device of claim 5, wherein said band of elasticized material has a diameter less than any diameter of said hair retainer when said headband is worn on said wearer's head.

8. The device of claim 5, wherein said hair retainer is at least partially stiff to maintain said hair retainer as frustoconical in shape and prevent said hair retainer from resting upon said hair.

9. The device of claim 5, wherein the fabric of the second fabric covering is terrycloth and said stiffening material is mesh.

10. A hair band, comprising:

continuous twofold fabric having an interior surface and an exterior surface forming an annular inner edge and an annular outer edge of said hair band;

an elastic portion disposed within a first portion of said interior surface of said twofold fabric, said first portion along said inner edge of said hair band, wherein the fabric of the first portion is puckered to allow said elastic portion to expand therein; and stiffening material disposed within a second portion of said interior surface of said twofold fabric, said second portion along said outer edge of said hair band, wherein said second portion is frustoconical in shape and extends upwardly from said first portion terminating at a generally circular retaining lip circumscribing an opening.

11. The hair band of claim 10, further wherein said elastic is a band continuously bound to said twofold fabric.

12. The hair band of claim 11, further comprising stitching through both said twofold fabric and said elastic.

13. The hair band of claim 10, wherein said twofold fabric is terrycloth.

14. The hair band of claim 10, wherein said stiffening material is mesh.

15. A device for retaining hair, comprising:

an annular elasticized headband for adjusting to human heads of varying sizes, said headband having an upper edge, said headband comprising a continuous elastic disposed within a first fabric covering, the first fabric covering puckered to allow said elastic to expand therein;

a frustoconically shaped hair retainer comprising a stiffening material disposed within a second fabric covering, said hair retainer extending upwardly from said upper edge and terminating at a generally circular retaining lip circumscribing an opening, said lip having a diameter and said upper edge having a diameter smaller than the said lip diameter to form a frustoconical collar for retaining hair without crushing said hair.

* * * * *